US006056181A

United States Patent [19]

Chuang

[11] Patent Number: 6,056,181

[45] Date of Patent: May 2, 2000

[54] FASTENING MACHINE

[75] Inventor: Hung-Ming Chuang, Ta Li, Taiwan

[73] Assignee: Besco Pneumatic Corp., Taichung Hsien, Taiwan

[21] Appl. No.: 09/379,744

[22] Filed: Aug. 24, 1999

[51] Int. Cl.[7] ..... B25C 1/04

[52] U.S. Cl. ..... 227/8; 227/120; 227/156

[58] Field of Search ..... 227/8, 120, 135, 227/136, 156, 130

[56] References Cited

U.S. PATENT DOCUMENTS

| | | | |
|---|---|---|---|
| 4,197,974 | 4/1980 | Morton et al. | 227/120 |
| 4,463,888 | 8/1984 | Geist et al. | 227/8 |
| 5,180,091 | 1/1993 | Ota | 227/130 |
| 5,322,189 | 6/1994 | Oda | 227/120 |
| 5,441,191 | 8/1995 | Linden | 227/156 |
| 5,593,079 | 1/1997 | Mukoyama et al. | 227/120 |

*Primary Examiner*—Scott A. Smith
*Attorney, Agent, or Firm*—Rosenberg, Klein & Lee

[57] ABSTRACT

A fastening machine includes a magazine having a sliding member slidably disposed thereto in which an aperture is defined and a coil member is disposed with one end thereof fixedly connected to a top edge of the magazine. An operating member is disposed to the sliding member and has a first tongue extending through the aperture and located between the sliding member and the magazine, and a second tongue extending through the aperture and toward in opposite to the first tongue. A flange extends laterally from the sliding member and receives the second tongue therein. An actuating plate is disposed above the magazine and has a hole defined in an underside thereof, a pin retractably disposed to a top of the magazine with a spring mounted thereto so that when the magazine has no fasteners received therein, the pin will be pushed by the sliding member and inserted into the hole to limit the actuating plate from being moved.

3 Claims, 5 Drawing Sheets

FASTENING MACHINE

BACKGROUND OF THE INVENTION

1. Field of the Invention

The present invention relates to a fastening machine and, more particularly, to a fastening machine having a safety device disposed thereto and which limits an actuating plate of the fastening machine from being actuated when a magazine of the fastening machine has no fasteners received therein.

2. Brief Description of the Prior Art

Carpenters use fastening machines to connect two boards and the fastening machine is powered by pneumatic force so as to eject fasteners into boards. Fasteners are received in a magazine of the fastening machine in sequence, wherein the magazine has a lots of slits defined in an inner surface thereof so as to receive fasteners having different lengths. The fasteners are so thin so that they are difficult to be picked by hands and, furthermore, when the fasteners are moved in the magazine, they are often jammed. Once the fasteners are jammed, a user has to disengage the magazine from the machine to re-arrange the fasteners again. In addition, the conventional magazines are made of metal so that the user cannot know when the fasteners are used out, and this could damage the fastening machine because the pneumatic force are so powerful.

The present invention intends to provide a fastening machine to mitigate and/or obviate the above-mentioned problems.

SUMMARY OF THE INVENTION

In one aspect of the present invention, there is provided a fastening machine comprising a magazine detachably disposed thereto and an actuating plate disposed above the magazine. The actuating plate has a hole defined in an underside thereof and communicates with an interior of the magazine. A sliding member is slidably disposed to the magazine and has a coil member disposed thereto which has one end thereof fixedly connected to a top edge of the magazine so as to pull the sliding member moved along the magazine. The sliding member has an aperture defined laterally therethrough and a flange extending laterally therefrom to enclose a periphery defining the aperture.

An operating member is pivotally disposed in the sliding member and has a first tongue and a second tongue extending therefrom in two opposite directions. The first tongue extends from the aperture and is located between the magazine and the sliding member, and the second tongue extends through the aperture and is located within the flange. A spring is disposed to the sliding member and biasedly contacts the first tongue.

A stop extends from an inner side of the magazine so as to limit the first tongue pushed by the spring.

A pin is retractably disposed to a top of the magazine and has a spring mounted thereto so that a front end of the pin is pushed by the sliding member and a rear end of the pin is inserted into the hole to limit the actuating plate from being moved when there has no fasteners received in the magazine.

It is an object of the present invention to provide a fastening machine which cannot be operated when the fasteners run out.

It is another object of the present invention to provide a fastening machine wherein a sliding member will not be operated unintentionally except a second tongue received therein is touched.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
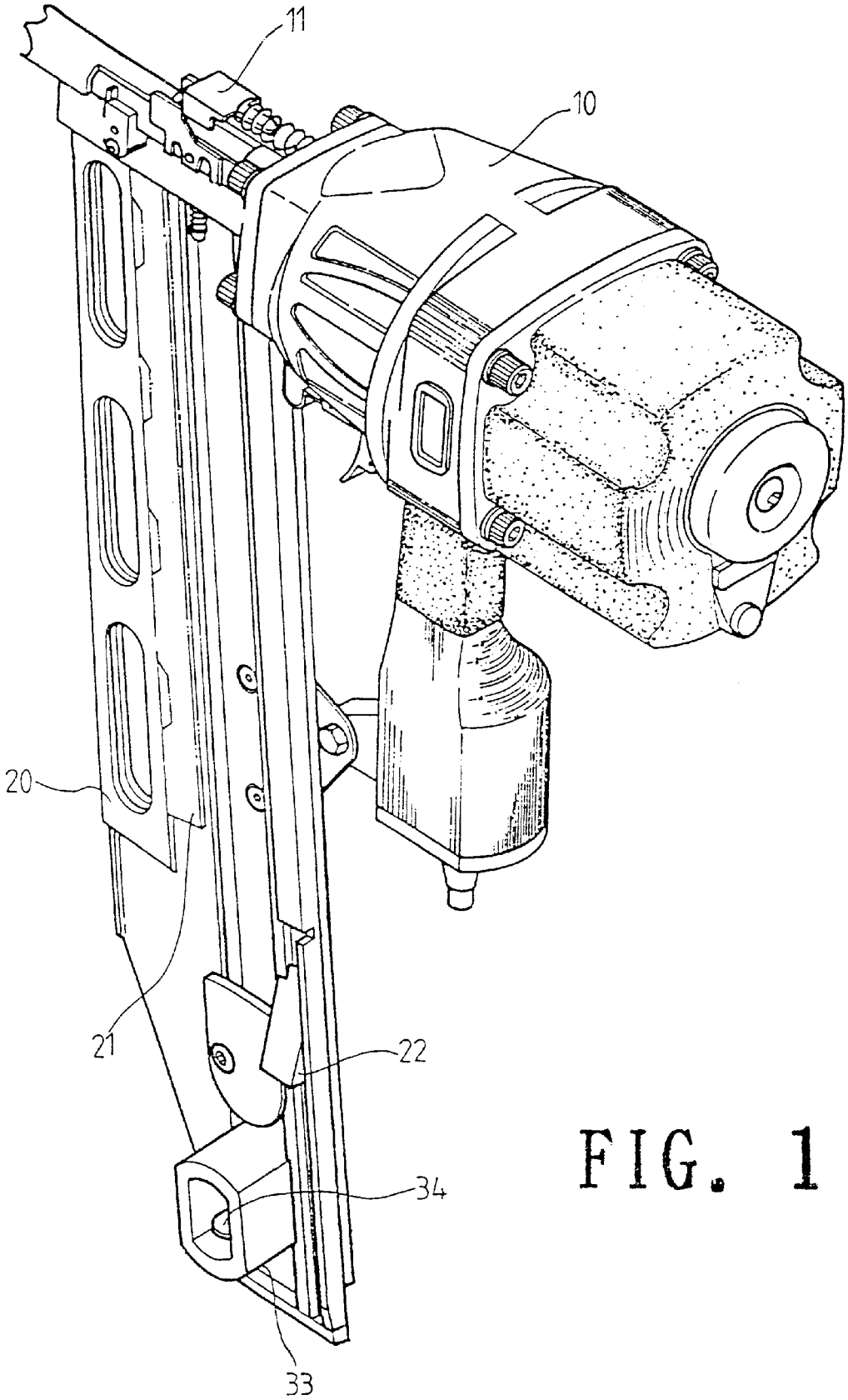
FIG. 1 is a perspective view of a fastening machine in accordance with the present invention.
Figure 2:
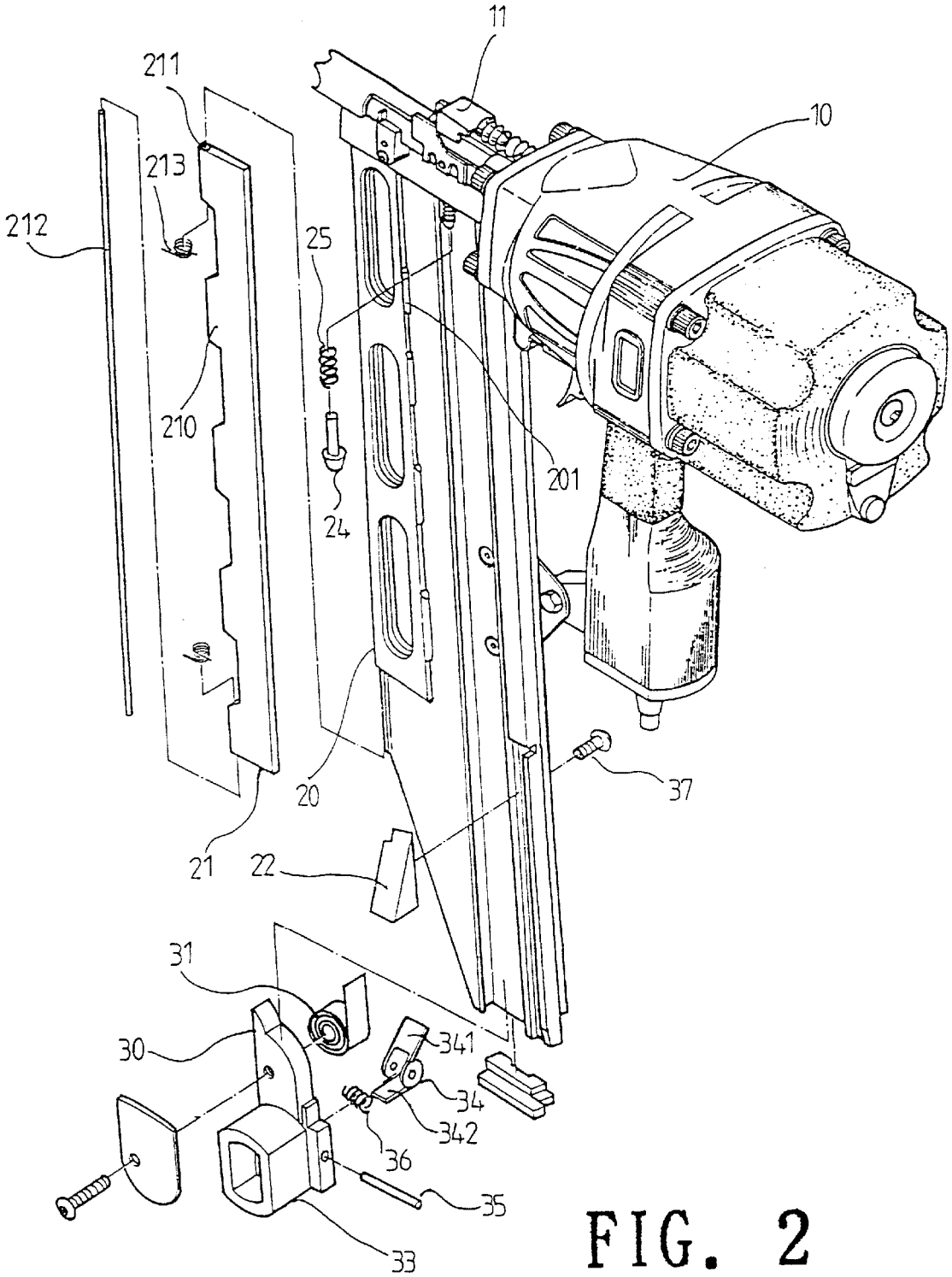
FIG. 2 is an exploded view of a safety device of the fastening machine in accordance with the present invention.
Figure 3:
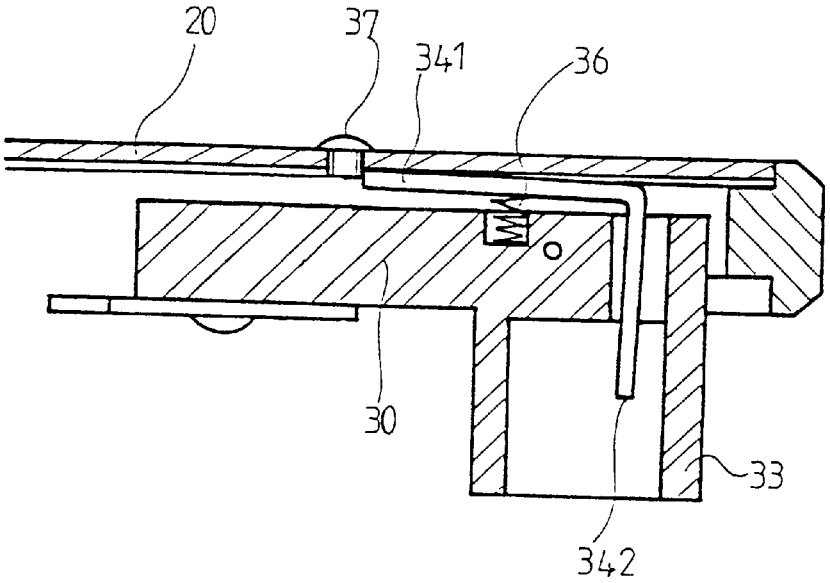
FIG. 3 is a side elevational view, partly in section, of a sliding member and an operating member disposed to the magazine, when the sliding member is positioned by the operating member.
Figure 5:
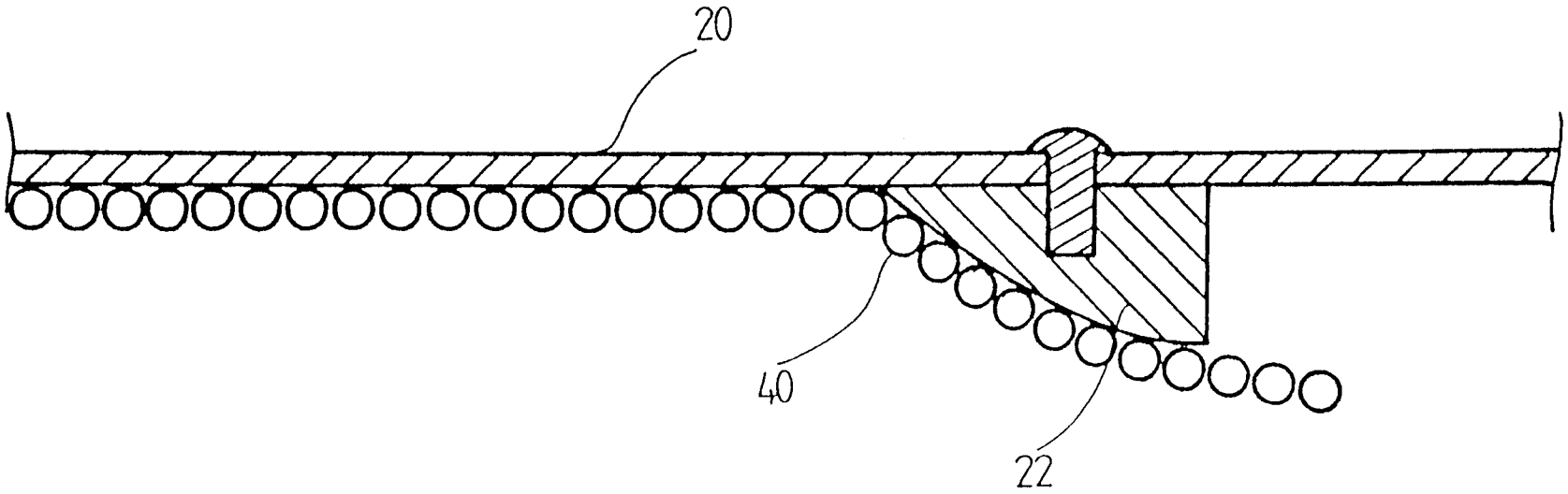
FIG. 5 is an illustrative view to show fasteners are arranged along the magazine and a block disposed to the magazine.

Referring to the drawings and initially to FIGS. 1 through 3, a fastening machine in accordance with the present invention generally includes a magazine 20 which is detachably disposed to a body 10 thereof and having a plurality of slots defined therein so as to receive fasteners 40 (see FIG. 5) with different lengths. An actuating plate 11 is disposed to a front end of the body 10 and located above the magazine 20 so that the actuating plate 11 can be actuated by pneumatic power to eject a fastener 40. The actuating plate 11 has a hole 12 defined in an underside thereof (see FIGS. 6 and/or 7) and communicating with an interior of the magazine 20. The magazine 20 has a plurality of tubular members 201 disposed thereto and a pressing plate 21 has a plurality of protrusions 210 extending from a side thereof, wherein each of the protrusions 210 has a passage 211 defined therethrough. A rod 212 extends through the passages 211 and the tubular members 201 with at least one torsion spring 213 mounted thereto so as to push the pressing plate 21 toward the magazine 20. Therefore, fasteners can be pressed by the pressing plate 21. A block 22 is disposed to the magazine 20 and has a curved surface formed on a top thereof so that fasteners 40 as shown in FIG. 5 are raised on the block 22 and easily to be pick up or arranged.

A sliding member 30 is slidably disposed to the magazine 20 and has a coil member 31 disposed thereto which has one end thereof fixedly connected to a top edge of the magazine 20 (see FIGS. 6 and/or 7) so that the sliding member 30 is pulled toward the actuating plate 11 by the coil member 31. An aperture 301 is defined laterally through the sliding member 30 and a flange 33 extends laterally from the sliding member 30 to enclose a periphery defining the aperture 301.

An operating member 34 is pivotally disposed in the sliding member 30 by a pin member 35 and has a first tongue 341 and a second tongue 342 extending therefrom in two opposite directions. The first tongue 341 extends from the aperture 301 and is located between the magazine 20 and the sliding member 30 as shown in FIG. 3, the second tongue 342 extending through the aperture 301 and located within the flange 33. A spring 36 is disposed to the sliding member 30 and biasedly contacts the first tongue 341 toward the magazine 20. A stop 37 extends from an inner side of the magazine 20 so that the first tongue 341 is pushed by the spring 36 and stopped against the stop 37.

Figure 4:
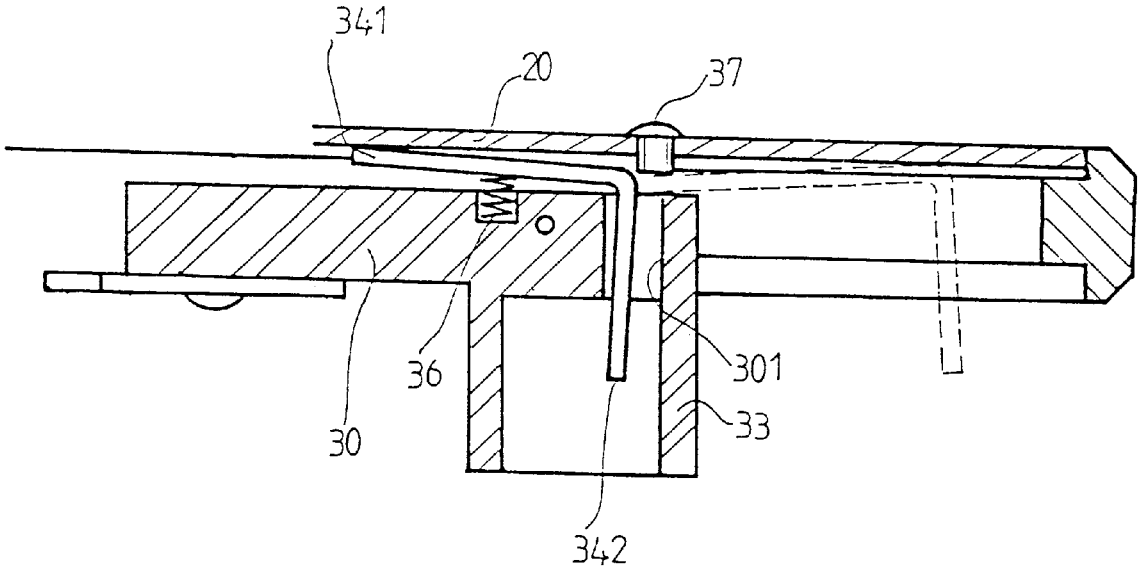
FIG. 4 is a side elevational view, partly in section, of the sliding member which is moved when the operating member is touched.

Referring to FIGS. 3 and 4, a pin 24 is retractably disposed to a top of the magazine 20 and has a spring 25 mounted thereto so that a front end of the pin 24 can be pushed by the sliding member 30 to push a rear end of the pin 24 inserted into the hole 12 to limit the actuating plate 11 from being moved.

Figure 6:
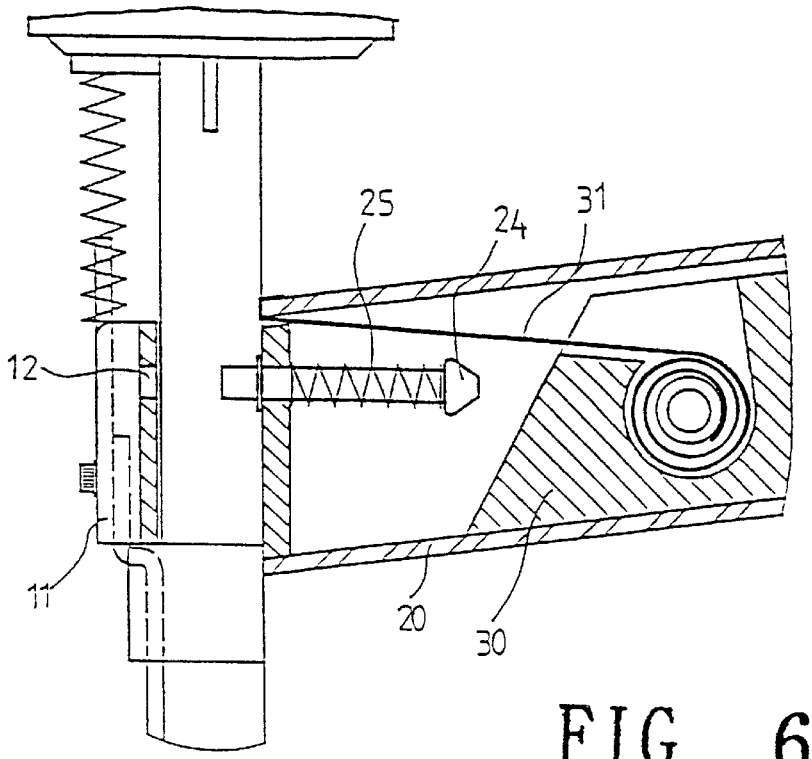
FIG. 6 is a side elevational view, partly in section, of the sliding member moved to a top of the magazine which has no fasteners therein, and not yet contacting a pin disposed to the top of the magazine.
Figure 7:
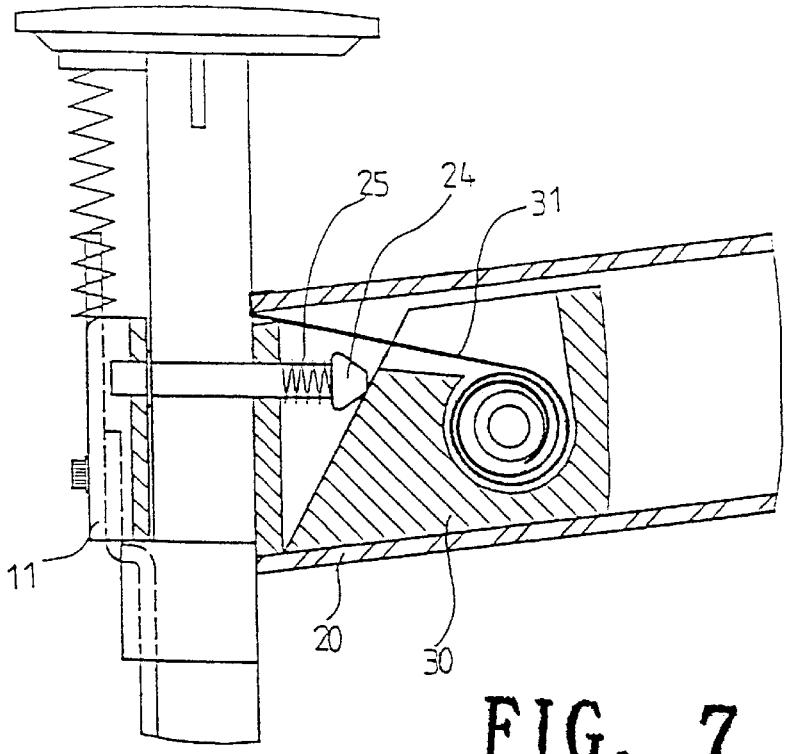
FIG. 7 is a side elevational view, partly in section, of the sliding member moved to push the pin inserted into a hole defined in an underside of an actuating plate to limit the actuating plate from being moved.

Referring to FIG. 4, when fasteners 40 are disposed in the magazine 20, a user's finger (not shown) is inserted into the flange 33 and pushes the second tongue 342 to disengage the first tongue 341 from the stop 37 so that the sliding member 30 is pulled by the coil member 31 and to biasedly contact the fasteners 40. Therefore, the fasteners 40 will be pushed to feed the actuating plate 11. When the fasteners 40 are used out, as shown in FIGS. 6 and 7, the sliding member 30 is pulled to push the front end of the pin 24 to let the rear end of the pin 24 be inserted into the hole 12 so that the actuating plate 11 is limited from being moved. Accordingly, the present invention provides a feature of automatically stop when fasteners 40 are used out, which protects the fastening machine.

Although the invention has been explained in relation to its preferred embodiment, it is to be understood that many other possible modifications and variations can be made without departing from the spirit and scope of the invention as hereinafter claimed.

What is claimed is:

1. A fastening machine comprising:

a magazine detachably disposed thereto and an actuating plate disposed above said magazine, said actuating plate having a hole defined in an underside thereof and communicating with an interior of said magazine;

a sliding member slidably disposed to said magazine and having a coil member disposed thereto which has one end thereof fixedly connected to a top edge of said magazine, an aperture defined laterally through said sliding member and a flange extending laterally from said sliding member to enclose a periphery defining said aperture;

an operating member pivotally disposed in said sliding member and having a first tongue and a second tongue extending therefrom in two opposite directions, said first tongue extending from said aperture and located between. said magazine and said sliding member, said second tongue extending through said aperture and located within said flange, a spring disposed to said sliding member and biasedly contacting said first tongue;

a stop extending from an inner side of said magazine so as to limit said first tongue pushed by said spring;

a pin retractably disposed to a top of said magazine and having a spring mounted thereto so that a front end of said pin is pushed by said sliding member and a rear end of said pin is inserted into said hole to limit said actuating plate from being moved.

2. The fastening machine as claimed in claim 1 wherein a block is disposed to said magazine and has a curved surface formed on a top thereof.

3. The fastening machine as claimed in claim 1 wherein said magazine has a pressing plate disposed thereto, said magazine having a plurality of tubular members disposed thereto and said pressing plate having a plurality of protrusions extending from a side thereof, each of said protrusions having a passage defined therethrough so that a rod extending through said passages and said tubular members with at least one torsion spring mounted thereto so as to push said pressing plate toward said magazine.

* * * * *